US010794605B2

(12) United States Patent
Coogan et al.

(10) Patent No.: US 10,794,605 B2
(45) Date of Patent: Oct. 6, 2020

(54) LABORATORY VENTILATION INTEGRATION

(71) Applicant: Siemens Schweiz AG, Zurich (CH)

(72) Inventors: James J. Coogan, Des Plaines, IL (US); Matthias Blask, Zug (CH); Gregory Kempf, Silver Lake, WI (US)

(73) Assignee: Siemens Schweiz AG, Zurich (CH)

( * ) Notice: Subject to any disclaimer, the term of this patent is extended or adjusted under 35 U.S.C. 154(b) by 0 days.

(21) Appl. No.: 15/455,768

(22) Filed: Mar. 10, 2017

(65) Prior Publication Data

US 2018/0259205 A1 Sep. 13, 2018

(51) Int. Cl.

| | |
|---|---|
| ***F24F 7/00*** | (2006.01) |
| ***F24F 11/00*** | (2018.01) |
| ***F24F 11/30*** | (2018.01) |
| ***B08B 15/02*** | (2006.01) |
| ***F24F 7/06*** | (2006.01) |
| ***B08B 15/00*** | (2006.01) |

(52) U.S. Cl.

CPC ..... *F24F 11/30* (2018.01); *B08B 15/002* (2013.01); *B08B 15/023* (2013.01); *F24F 7/00* (2013.01); *F24F 7/06* (2013.01); *F24F 11/0001* (2013.01); *F24F 2007/001* (2013.01); *F24F 2011/0005* (2013.01)

(58) Field of Classification Search

CPC ..... F24F 11/0001; F24F 11/30; F24F 2110/40
USPC ..... 454/238–239, 56, 57, 61, 67, 58
See application file for complete search history.

(56) References Cited

U.S. PATENT DOCUMENTS

| | | | | |
|---|---|---|---|---|
| 4,497,242 | A | 2/1985 | Moyer | |
| 5,115,728 | A | 5/1992 | Ahmed et al. | |
| 5,205,783 | A * | 4/1993 | Dieckert | B08B 15/023 454/238 |
| 5,764,579 | A | 6/1998 | McMasters et al. | |
| 5,971,067 | A * | 10/1999 | Rayburn | F24F 11/30 165/217 |
| 6,154,686 | A | 11/2000 | Hefferen et al. | |
| 7,066,091 | B2 * | 6/2006 | Kumar | B41F 33/0018 101/484 |
| RE44,146 | E * | 4/2013 | Bagwell | B08B 15/00 236/49.3 |
| 2003/0097204 | A1 | 5/2003 | Coogan | |

(Continued)

FOREIGN PATENT DOCUMENTS

WO 92/08082 A1 5/1992

OTHER PUBLICATIONS

Siemens Industry, Inc., Building Technologies Division, "BACnet LCM-OAVS Room Pressurization with Fast-acting Damper Actuation (One Exhaust, One Supply) and Hot Water Reheat," Owners Manual, Jun. 29, 2015, 27 pages.

(Continued)

*Primary Examiner* — Vivek K Shirsat
*Assistant Examiner* — Ko-Wei Lin

(57) ABSTRACT

Laboratory ventilation is integrated. The HVAC room controller requests changes in the exhaust set point of one or more fume hoods. By allowing the fume hoods to respond to such HVAC requests, the fume hood exhaust may be turned down to a point below the highest level that could be needed. The request may be used to turn the fume hood exhaust back up, so greater energy savings may be possible in non-peak demand operation of the HVAC system.

14 Claims, 4 Drawing Sheets

(56) References Cited

U.S. PATENT DOCUMENTS

| | | | | |
|---|---|---|---|---|
| 2003/0171092 | A1* | 9/2003 | Karamanos | F24F 11/74 454/233 |
| 2004/0144849 | A1* | 7/2004 | Ahmed | G05B 15/02 236/1 E |
| 2009/0047894 | A1 | 2/2009 | Coogan | |
| 2009/0314847 | A1* | 12/2009 | Nemoto | B60H 1/00764 237/5 |
| 2011/0053488 | A1* | 3/2011 | Gans | B08B 15/002 454/343 |
| 2012/0055460 | A1* | 3/2012 | Lambertson | F24F 7/06 126/299 D |
| 2012/0097360 | A1* | 4/2012 | Ohba | H05K 7/20 165/11.1 |
| 2012/0270488 | A1* | 10/2012 | Fujimura | F24F 11/0001 454/56 |
| 2013/0066474 | A1 | 3/2013 | Coogan et al. | |
| 2013/0218349 | A1 | 8/2013 | Coogan et al. | |
| 2013/0253709 | A1 | 9/2013 | Renggli et al. | |
| 2014/0343731 | A1 | 11/2014 | Brun et al. | |
| 2016/0018121 | A1* | 1/2016 | Osawa | F24F 11/72 454/238 |

OTHER PUBLICATIONS

Siemens Industry, Inc., Building Technologies Division, "BACnet Fume Hood Controller Vertical Sash with Damper or Venturi Air Valve and 2-Position Constant Volume with Damper," Owners Manual, Oct. 14, 2015, 28 pages.

EP Search Report dated Jul. 19, 2018, for EP Application No. 18158820.3, 7 pages.

* cited by examiner

LABORATORY VENTILATION INTEGRATION

FIELD

The present embodiments generally relate to ventilation in laboratories and, more particularly, to integrating different sources of ventilation.

BACKGROUND

A typical laboratory ventilation system includes general exhaust ventilation from the heating, ventilation, and air conditioning (HVAC) system and includes local exhaust ventilation from fume hoods. The fume hoods are provided for purposes other than HVAC, so are operated autonomously. The fume hoods set their flow rates independently of other consideration in the room. The fume hoods communicate their exhaust flow rates to the room controller for HVAC, but this integration is for the HVAC system to use to control the general exhaust ventilation based on total exhaust.

Reduction in total exhaust allows for reduction in HVAC air supply, so energy may be conserved. The exhaust from fume hoods may be set to limit the total exhaust. However, reduction in the set point for the exhaust flow from hoods stops at the point that the air might be needed to balance cooling flow or general ventilation. The cooling or heating demand may require greater air supply than can be exhausted by the general exhaust, so the fume hood exhausts are set at a level that can deal with this difference regardless of the actual cooling or heating demand. Flow rates for the fume hoods are only turned down to the highest level that could be needed to satisfy other demands in the room. This limits efforts to conserve energy.

SUMMARY

By way of introduction, the preferred embodiments described below include methods, systems, instructions, and computer readable media for laboratory ventilation integration. The HVAC room controller requests changes in the exhaust set point of one or more fume hoods. By allowing the fume hoods to respond to such HVAC requests, the fume hood exhaust may be turned down to a point below the highest level that could be needed. The request may be used to turn the fume hood exhaust back up, so greater energy savings may be possible in non-peak demand operation of the HVAC system.

In a first aspect, an integration system is provided for laboratory ventilation. A heating ventilation and air conditioning (HVAC) system includes a room controller and an HVAC exhaust damper responsive to the room controller. A hood includes a hood controller and a hood exhaust damper responsive to the hood controller. A communication link is between the room controller and the hood controller. The room controller is configured to request a first air flow from the hood based on operation of the HVAC system, and the hood controller is configured to adjust a second air flow from the hood in response to the request.

In a second aspect, a method is provided for laboratory ventilation integration. Conditioned air is supplied to a laboratory. The conditioned air is exhausted from the laboratory from a room exhaust and a hood exhaust. The exhausting creates a negative pressure by exhausting at a greater rate than supplying. The supplying and exhausting are varied in response to a change in a heating or cooling demand of the laboratory. The variation of the exhausting includes varying the hood exhaust in the response to the change in the heating or cooling demand of the laboratory.

In a third aspect, a system is provided for laboratory ventilation integration. A fume hood is in a laboratory. A controller of the fume hood has an interface for communicating with a heating, ventilation, and air conditioning (HVAC) application for the laboratory. The controller is configured to change a set point to increase air flow by the fume hood in response to a message received at the interface from the HVAC application.

The present invention is defined by the following claims, and nothing in this section should be taken as a limitation on those claims. Further aspects and advantages of the invention are discussed below in conjunction with the preferred embodiments and may be later claimed independently or in combination.

BRIEF DESCRIPTION OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION

Lab room ventilation is enhanced by integration of local exhaust ventilation (e.g., from a hood) and room ventilation (e.g., from a general HVAC exhaust). The room controller may request a local exhaust ventilation device to increase exhaust flow. The controller for the local exhaust ventilation device receives the request and may increase exhaust flow in response. The local exhaust ventilation flow controller evaluates the request from the room controller. If the higher flow is possible and does not interfere with correct local exhaust ventilation operation, the local exhaust ventilation controller sets a higher flow rate. The local exhaust ventilation controller continues to communicate actual flow rate to the room controller. With increased local exhaust ventilation air flow, the room controller is free to increase supply flow for cooling or for room air replacement even where the room ventilation is at a maximum flow.

Figure 1:
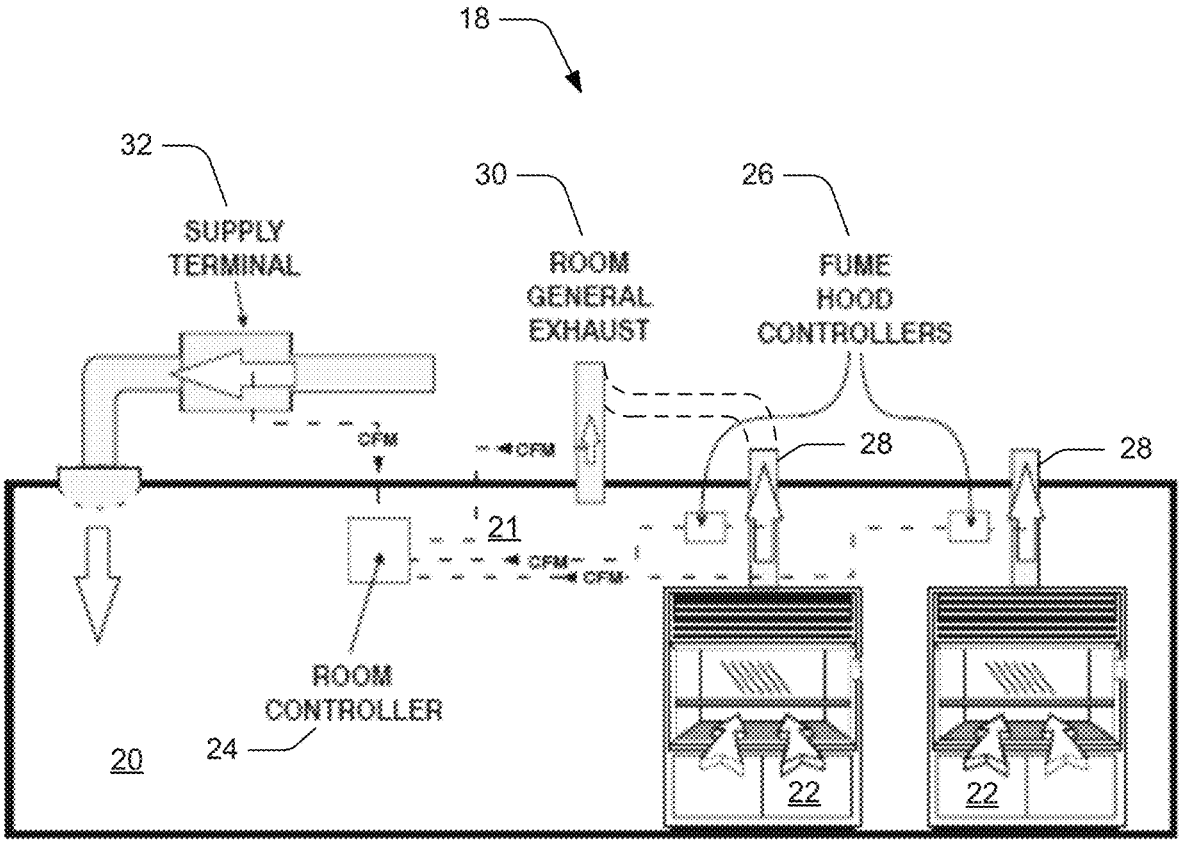
FIG. 1 shows an example laboratory with an HVAC system and fume hoods with integrated ventilation.

FIG. 1 shows an example embodiment of a laboratory 20 with an integration system for laboratory ventilation. For operation of the HVAC system 18, the exhaust provided by local devices, such as hoods 22, is integrated. The integration allows the HVAC system to request change in exhaust of the hoods 22 due to HVAC demand. The exhaust of the hoods 22 may be adjusted to set the air supply to condition the air or maintain temperature.

The laboratory 20 is a room, group of rooms, or building. The laboratory 20 includes a system for laboratory ventilation integration. Hoods or other devices providing ventilation for operation of the laboratory are integrated with the HVAC for the laboratory. Ventilation provided at a workstation or localized within the laboratory is integrated with HVAC ventilation provided for a room. Localized ventilation due to use of chemicals, flame, or other safety reasons is responsive to general HVAC ventilation. The integration provides for change in localized ventilation in response to HVAC demand as well as to fulfill the purpose of the localized ventilation.

The integration system in the laboratory 20 includes a communications network 21, hoods 22, a room controller 24, hood controllers 26, dampers 28 for hood exhaust, a damper 30 for general room exhaust, and a damper 32 for air supply. Additional, different, or fewer components may be provided. For example, fans are used instead of dampers 28, 30, and/or 32. As another example, additional room controllers 24 are provided. In yet another example, any number of hoods 22 are provided.

The communications network 21 includes one or more links between the room controller 24 and the hood controllers 26. Direct or indirect communications may be provided. The controllers 24, 26 are interconnected using a building automation network. Any networking or communications may be used, such as TCP/IP, master slave token pathing (MSTP), or KONNEX (KNX). BACnet and/or other protocols that support data communications may operate as overlays on the network or networks. In some embodiments, the controller 26 may function as a router enabling communication between various components. In one embodiment, a field level network (FLN) is used for the communications links. For communicating the data, electrical, wired, or wireless communication media are used.

The HVAC system includes the room controller 24, general room exhaust 30, and conditioned air supply damper 32. Examples of building automation systems including the HVAC system are the APOGEE® system commercially available from Siemens Industry, Inc. of Buffalo Grove, Ill. and the DESIGO® system commercially available from Siemens Schweiz AG of Zug, Switzerland. The APOGEE® system and the DESIGO® system each allow the setting and/or changing of various controls. Other now known or later developed building automation systems may be used.

Any combination of sensors, actuators, user input devices, displays, air handling, or other equipment may be used. Heating without air conditioning or vice versa may be provided. In one embodiment, the HVAC system includes a supply air temperature sensor, a heating coil, a fan, a chilled ceiling, and/or a room unit. Sensors may be temperature, pressure, rate, flow, air velocity, current, voltage, inductance, capacitance, chemical, or other sensors. Any number of sensors may be used. The dampers 30, 32 are operated by actuators. The actuators may be gas, magnetic, electric, pneumatic, or other devices for adjusting the damper 30, 32. Variable speed motors and fans may be used instead of or in addition to dampers 30, 32.

In one example, the HVAC system includes temperature sensors and ventilation damper controls. The air supply damper 32 is adjusted to supply conditioned air to heat or cool the laboratory 20 as needed based on temperature from the temperature sensor. The general exhaust damper 30 is adjusted to exhaust supplied air while maintaining negative pressure in the laboratory 20. The exhaust draws air out of the laboratory at a greater rate than the supply supplies air. The difference creates a negative pressure so that transfer flow through doors, windows, or other air leaks is drawn into the laboratory 20, preventing chemicals, pathogens, or other material or gases from exiting the laboratory 20 other than through a planned exhaust.

The air supply damper 32 is a valve and actuator. Heated, cooled, filtered, or otherwise conditioned air is provided to the air supply damper 32. By moving the valve, such as a plate, the amount of air supplied to the laboratory 20 is controlled. While one air supply damper 32 is shown, more than one may be provided for the laboratory 20.

The general room exhaust damper 30 is a valve and actuator. Air from the laboratory 20 is drawn through one or more vents and/or ducts through the general room exhaust damper 30 to an exhaust duct. By moving the valve, such as a plate, the amount of air drawn from the laboratory 20 is controlled. The actuator is responsive to the room controller 24. While only one general room exhaust damper 30 is shown, more than one may be provided for the laboratory 20.

A fan of the exhaust duct draws the air through the damper 30. The exhaust duct is separate from or shared with the hood dampers 28.

The room controller 24 implements control processes for the HVAC system. While one room controller 24 is shown, multiple room controllers may be used, such as for zoned operation. One room controller 24 may implement HVAC control processes for more than one room. For example, a modular controller (e.g., PXC3 available from Siemens) automates and control multiple rooms.

The room controller 24 is a panel, programmable logic controller, workstation, operator station, and/or remote terminal unit. The controller 24 includes a computer, processor, circuit, or other programmable devices for automation of HVAC operations or processes. For example, a DXR controller available from Siemens is used to automate and control one room 22. The controller 24 controls the air supply damper 32 and general room exhaust damper 30 based on one or more temperature sensors in the laboratory.

Figure 2:
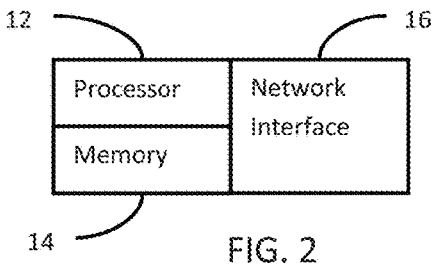
FIG. 2 is a block diagram of one embodiment of a controller.

FIG. 2 illustrates one embodiment of the controller 24. The components of the controller 24 include a processor 12, memory 14, and network interface 16. These parts provide for operation and communication in the building automation system. Additional, different, or fewer parts may be provided. For example, a display is provided. Any type of display may be used, such as LEDs, monitor, LCD, projector, plasma display, touch screen, CRT, or printer.

The processor 12 is a general processor, central processing unit, control processor, graphics processor, digital signal processor, application specific integrated circuit, field programmable gate array, digital circuit, analog circuit, combinations thereof, or other now known or later developed device for HVAC or actuator control. The processor 12 is a single device or multiple devices operating in serial, parallel, or separately. The processor 12 may be a main processor of a computer, such as a laptop or desktop computer, or may be a processor for handling tasks in a purpose-built system, such as in a programmable logic controller or panel. The processor 12 is configured by software and/or hardware.

The memory 14 is a system memory, random access memory, cache memory, hard drive, optical media, magnetic media, flash drive, buffer, database, graphics processing memory, video random access memory, combinations thereof, or other now known or later developed memory device for storing data. The memory 14 stores one or more datasets representing sensor readings, set points, and/or actuator status. The memory 14 may store calculated values or other information for reporting or operating in the system with integrated ventilation. For example, event data is stored. The memory 14 may buffer or store received communications, such as storing messages for parsing. Control functions and/or programming objects may be stored.

The memory 14 or other memory is a non-transitory computer readable storage medium storing data representing instructions executable by the programmed processor 12 for control of dampers 30, 32. The instructions for implementing the processes, methods and/or techniques discussed herein are provided on computer-readable storage media or memories, such as a cache, buffer, RAM, removable media, hard drive or other computer readable storage media. Computer readable storage media include various types of volatile and nonvolatile storage media. The functions, acts or tasks illustrated in the figures or described herein are executed in response to one or more sets of instructions stored in or on computer readable storage media. The functions, acts or tasks are independent of the particular type of instructions set, storage media, processor or processing strategy and may be performed by software, hardware, integrated circuits, firmware, micro code and the like, operating alone, or in combination. Likewise, processing strategies may include multiprocessing, multitasking, parallel processing, and the like.

In one embodiment, the instructions are stored on a removable media device for reading by local or remote systems. In other embodiments, the instructions are stored in a remote location for transfer through a computer network or over telephone lines. In yet other embodiments, the instructions are stored within a given computer, CPU, GPU, or system.

The network interface 16 is a physical connector and associated electrical communications circuit for networked or direct communications. For example, a network card is provided. As another example, a jack or port is provided. In one embodiment, the network interface 16 includes an Ethernet connector and corresponding circuit, such as a PHY chip, a PL-link port, and/or a master-slave token pathing (MSTP) port. Multiple ports of a given type may be used. Alternatively, wireless or other wired connection is provided as the interface.

The controller 24 has a network address or other identity for communicating within the building automation system. The sensors or actuators of the environmental control equipment may or may not have network addresses, since the networking of communications for the environmental control equipment may be by direct connection to ports on the controllers 24. The network addresses correspond to the physical network interface 16 for the controller 24. Communications within the building automation system are routed to and from the controller 24 over one or more of the communications links. The physical network interfaces 16 connect the controller 24 to the building automation system for receiving and transmitting communications, such as messages, with the hood controllers 26.

The controller 24 is configured to provide overall control and monitoring of the HVAC system in accordance with any commands. The controller 24 may operate as a data server that is capable of exchanging data with various elements of the environmental control equipment. As such, the controller 24 may allow access to system data by various applications that may be executed on the controller 24 or other supervisory computers, such as a management server or client workstation.

Referring again to FIG. 1, the room controller 24 is configured to control the HVAC system (e.g., the supply damper 32 and the general exhaust damper 30). The controller 24 operates based on programming. The room controller 24 includes control logic for operating and/or monitoring the building automation.

To assist in HVAC control, the room controller 24 is configured to interact with the hood controllers 26. To determine the setting of the air supply damper 32, the room controller 24 determines the air demand or load, such as air dilution, air exchange, heating demand or cooling demand. The room controller 24 determines the total exhaust from the laboratory needed for the given air supply and desired negative pressure (i.e., desired transfer flow). To determine the total exhaust, the amount of exhaust contributed by the hoods 22 is included. The hood controllers 26 report the settings for the hood exhaust dampers 28. In one embodiment, the setting is communicated as an air flow (e.g., volume flow) of the hood 22. Other information may be communicated to the room controller 24, such as a maximum and/or minimum flow possible by the hood 22.

Rather than relying only on the general room exhaust damper 30 or where the general room exhaust damper 30 cannot meet the exhaust requirements necessitated by the air supply setting, the room controller 24 is configured to request an air flow from the hood 22. Based on operation of the HVAC system, the hood 22 may be requested to provide additional exhaust. The request is to the hood controller 26, such as a controller of the hood exhaust damper 28. The room controller 24 may request the local exhaust ventilation device to increase exhaust flow. With increased local exhaust ventilation air flow, the room controller 24 is free to increase supply flow for cooling or for room air replacement. The room controller 24 may request the local exhaust ventilation device to decrease exhaust flow.

The request may have any format. In one embodiment, the request is a percentage. The room controller 24 uses the maximum possible air flow provided by the hood 22 (e.g., from the hood controller 26) to calculate the percentage of that maximum desired for HVAC exhaust assistance. In one embodiment, the fume hood request value, calculated in physical flow units, is scaled to a percentage between the minimum and maximum flow values collected from the fume hood 22 or hoods 22. The percentage is distributed to the hoods 22. In alternative embodiments, the request is for a different set point or an amount of change from the current set point.

Since the hoods 22 may operate independent from HVAC, such as for local ventilation safety purposes, the hood 22 may not provide the requested level of exhausting. The room controller 24 uses the provided exhaust levels from the hoods 22 to determine the air supply flow. Any available increase in exhaust allows for greater air supply flow rate. The hoods 22 increase the exhaust over a current set point in response to the request for HVAC purposes. Where the current set point is less than the maximum possible, the request may be created to get the hoods 22 to contribute more exhaust for HVAC purposes.

In one embodiment, the room controller 24 is configured to generate the request for change in exhaust to the hoods 22 when the HVAC exhaust damper 30 is at a maximum. Only after the HVAC exhaust damper 30 cannot contribute more exhaust, the request is generated. Usually fume hoods 22 operate independently. When the general exhaust capacity is not enough to balance the desired supply flow, the request is generated. The flow requested is the value that balances the desired room flow, with the general exhaust at the maximum. This approach uses general exhaust flow "first" before asking the hoods 22 to increase flow. However, the hoods 22 may run at a higher flow than requested. Based on the reported flow from the hoods 22, the room controller 24 may then adjust the general room exhaust damper 30 to provide less flow than the maximum to have the desired total exhaust. In alternative embodiments, the request is generated with the general room exhaust damper 30 at less than the maximum.

Where more than one hood 22 is provided, the room controller 24 generates separate requests for each hood 22. For example, hoods 22 are assigned priority and/or the hoods 22 with the least air flow at the current set point are requested first or to contribute more. Different hoods 22 may be requested to alter air flow by the same or different amounts. In other embodiments, a same request is sent to all or a sub-set of the hoods 22. In either approach, the request or requests are distributed between the hoods 22. The request is sent to each of the hoods 22 or to hoods 22 in any order.

The hood controllers 26 might not increase the supply flow based on the request or may increase less than requested. The room controller 24 receives responses to the request. The responses may be messages as a response. Alternatively, the response is reflected in the set point communicated from the hood controllers 26. When the collected flow data from the hoods 22 show the increased flow, then the room controller 24 responds by increasing the air supply. An iterative process may be used to balance air supply and exhaust. Alternatively, the room-controller 24 receives back responses to the request and any remaining unbalance in supply verses exhaust is handled through the supply air damper 32 set point and the general room exhaust damper 30 set point.

The hood 22 is a fume hood. The hood 22 includes an intake positioned over or near a workstation in the laboratory 20. The hood 22 provides localized ventilation, such as for safety reasons, by a source of flame, chemical processing, germ handling, or other laboratory operation.

Two hoods 22 are shown in FIG. 1. Only one hood 22, or more than two hoods 22 may be provided. The hoods 22 may be of the same or different configurations.

Each of the hoods 22 has a separate hood controller 26 and hood exhaust damper 28. In other embodiments, two or more hoods 22 share a hood controller 26 and/or hood exhaust damper 28. Additional, different, or fewer components may be provided. For example, a sash, sash position sensor, air flow sensor, or other sensor is provided.

The hood exhaust damper 28 is an actuator and a valve. The same or different type of damper is provided for the hood exhaust damper 28 as the general room exhaust damper 30. The actuator of each hood exhaust damper 28 responds to and/or is controlled by the hood controller 26.

The hood controller 26 is of a same or different type of controller as the room controller 24. Any of the types of controllers described for the room controller 24 may be used for the hood controller 26. In one embodiment, the hood controller 26 is a field device just for controlling the hood exhaust damper 28. In other embodiments, the hood controller 26 is a general hood controller for controlling various aspects of hood operation, such as sash settings, lighting, emergency activation of ventilation, gas supply, and/or the hood exhaust damper 28.

The hood controller 26 includes an interface 16 for communicating with the room controller or other HVAC application for the laboratory 20. Using wired or wireless, direct or indirect communication, the hood controller 26 communicates with the room controller 24.

The hood controller 26 sends a current set point for air flow from the hood exhaust damper 28. The set point is sent as a physical position of the damper. Alternatively, the set point is sent as a value of air flow, such as derived from the physical position of the damper 28. Other formats for communicating the set point may be used, such as the signal indicating air flow being a flow value measured with a sensor, flow calculated from sensor measurements, a set point value, a flow value derived from a set point and measured values based on damper position, or other indication of set point for air flow.

The hood controller 26 also communicates a minimum and/or maximum possible value for the hood exhaust air flow. The maximum is of the exhaust without other considerations, such as based on a fully open position of the hood exhaust damper 28. Alternatively, the maximum accounts for other operations, such as a maximum given a current sash setting, as limited by default or user configuration, and/or based on use of the hood 22 (e.g., air flow velocity kept below a level that would extinguish a flame at the hood). Other information may be communicated from the hood controller 26 to the room controller 24.

The hood controller 26 communicates in response to a trigger event, such as when a setting or operation is changed. Alternatively, the hood controller 26 communicates periodically and/or in response to a message.

The hood controller 26 controls the air flow through the hood 22. The hood exhaust damper 28 is controlled to adjust or set the amount of air flow. Without a request from the room controller 24 or without responding to HVAC operation, the hood controller 26 controls the amount of air flow for localized ventilation for laboratory purposes. Any of various considerations may be used to control the air flow, such as sash settings, user setting, and/or the purpose for the hood 22.

In response to HVAC operation, the hood controller 26 may change a set point and/or amount of air flow exhausted by the hood 22. The air flow from the hood 22 is adjusted in response to a request from the room controller 24. For example, the set point is increased or decreased to provide more or less air flow in response to a message from an HVAC application. If a greater amount of exhaust is needed to provide for more flow of conditioned air into the laboratory 20, then the set point for the hood exhaust damper 28 may be adjusted to increase the amount of air flow exhausting from the hood 22. If a lesser amount of exhaust is needed to provide for energy savings where the general room exhaust is limited in air flow reduction, then the set point for the hood exhaust damper 28 may be adjusted to decrease the amount of air flow exhausting from the hood 22.

In one embodiment, the request is for increased exhaust. The supplemental exhaust feature increases the fume hood exhaust flow set point on request from a separate (e.g., room) application. This flexibility makes it easier to satisfy all the dynamic room air flow requirements and still apply measures to minimize fume hood exhaust for energy conservation. The requested flow rate is represented as a percentage of the configured maximum flow rate. The request is a BACnet Object, connected to the room application by group data exchange. The communications of the request are to all members of a group, such as all the hood controllers 26. The same percentage goes to all the hoods 22 in the laboratory 20. The response to that request is configured hood 22 by hood 22. The configured maximum flow rate for any given hood 22 is connected to the group member object for collection by the room application.

The hood controllers 26 respond independently of the other hood controllers 26. Each hood 26 runs a separate control process to determine the separate response. Different hoods 22 may be operating under different conditions, resulting in differences in the responses to the request. None, one, or more hoods 22 may respond by altering exhaust to a maximum or the requested set point. None, one, or more of the hoods 22 may respond by not altering the exhaust.

None, one, or more hoods 22 may respond by changing the set point by less than requested by the message. The air flow is adjusted (e.g., increased) but not adjusted to provide all the requested air flow. For many users, it is important that the fume hood controller 26 is autonomous, setting and controlling flow rate independently of other controls. The data to configure this increased exhaust feature is part of the configuration extension of the fume hood set point view node. The hood controller 26 for the hood exhaust damper 28 receives the request and may increase exhaust flow in response. The hood controller 26 evaluates the request from the room controller 24. If the higher flow is possible and does not interfere with correct hood 22 or local exhaust ventilation operation, the hood controller 26 sets a higher flow rate. The hood operation may limit the amount of change of the set point, such as to avoid air flow velocity that may complicate use of the workstation associated with the hood 22.

In one embodiment, the hood controller 26 adjusts the air flow as a function of the request and a setting of a sash area or velocity of the hood. Air velocity or sash area may be considered to limit the amount of adjustment. Air velocity or sash area may be sensed by an air flow sensor, a sash setting sensor, look-up from a sensed value, or a known setting. For example, with a request for increased exhaust from the hood 22 with a sash, the hood controller 26 calculates a locally required exhaust flow set point according to the configured sash sensing functions (e.g., face velocity, minimum flow, and/or maximum flow). The hood controller 26 also calculates a maximum available flow rate using current face area data and values for minimum flow, face velocity set point, and the configured maximum flow. This maximum limits the flow rate requested by the room controller 24. The hood controller 26 applies the larger value of the locally calculated set point and the limited flow.

Figure 3:
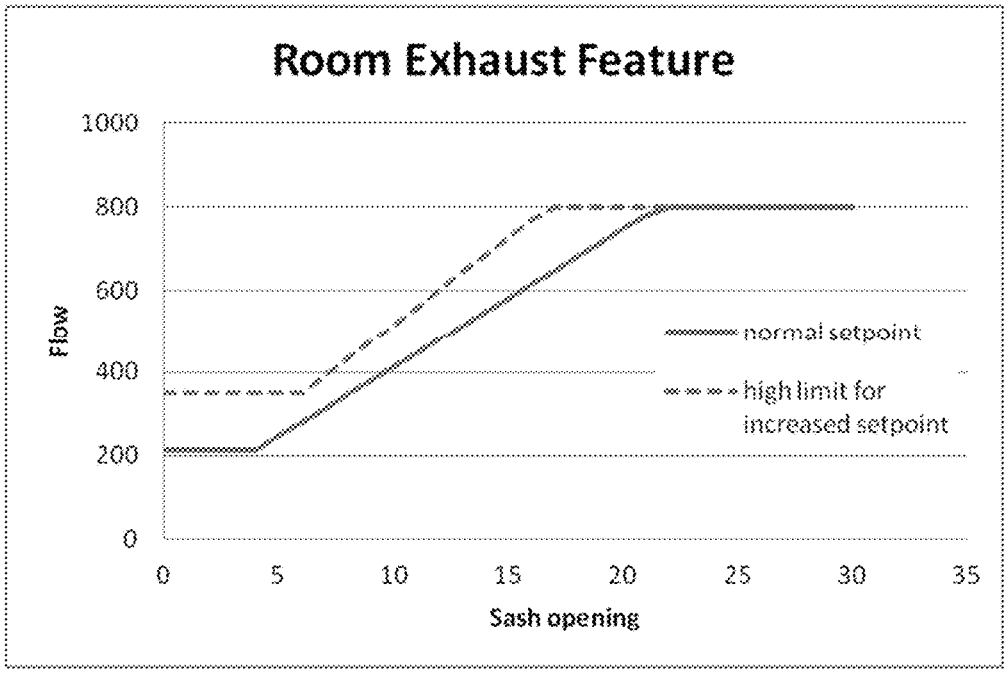
FIG. 3 is a graph illustrating an example sash-based limitation on hood exhaust for autonomous hood operation while also considering HVAC demand.
Figure 4:
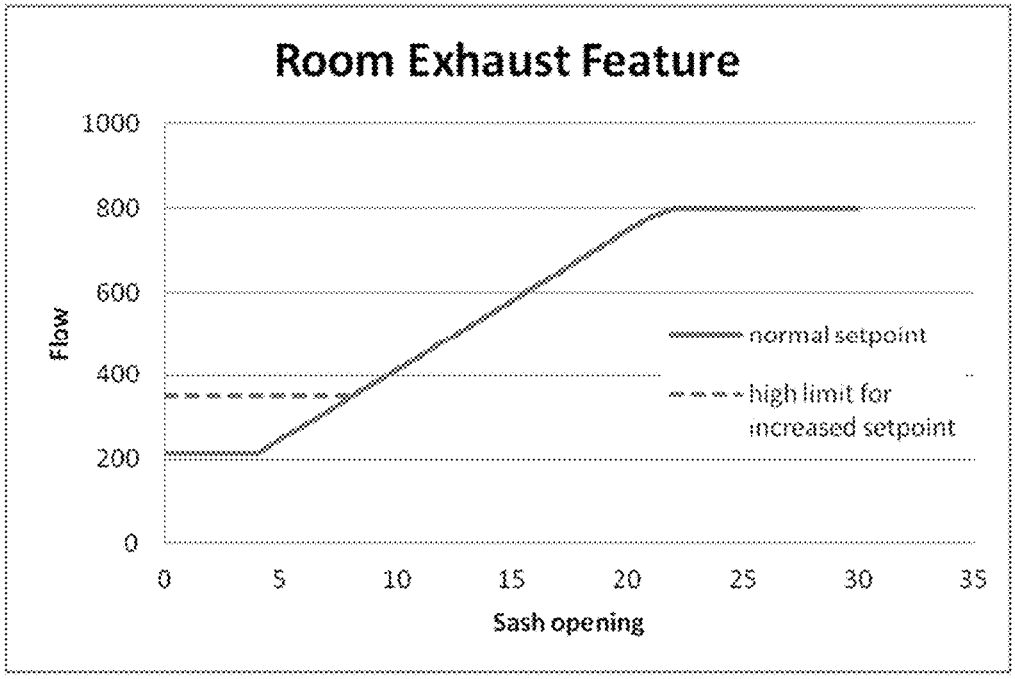
FIG. 4 is a graph illustrating an example velocity-based limitation on hood exhaust for autonomous hood operation while also considering HVAC demand.

FIG. 3 shows this example. The solid line with lower flow values represents a normal set point for the flow of the hood 22 as a function of the sash opening. The dashed line with greater flow values represents a possible greater air flow limited by the sash setting. The hood controller 26 selects the larger of the two values or in-between the two values for a given sash setting in response to a request for an increase. This larger value is an upper limit to respond to the request. Flow may be increased, but by an amount limited due to the current sash setting. Lesser increases may be provided. The hood controller 26 applies a face velocity control loop to calculate a flow setpoint required to maintain a selected face velocity. When this flow value is less than a selected lower limit, or minimum flow, the limit is applied. The hood controller responds to the request for increased flow by raising the flow level that serves as the lower limit on the face velocity control loop. FIG. 4 shows an example based on face velocity sensing for the hood 22. To increase exhaust, the hood controller 26 calculates the locally required flow set point using the face velocity set point and a minimum flow value that is increased to the requested flow level, but not more than a configured flow level representing the largest allowed minimum flow. The face velocity sensing combines a sash sensing function and a face velocity control loop. The sash sensing branch of the application is not affected by the flow request from the room. In the example of FIG. 4, the hood controller 26 may increase the air flow for a limited number of sash opening amounts. The requested flow level (e.g., percentage of the configured maximum flow) is compared to a flow level configured for the increased flow. The smaller value is used as the requested flow rate. If the smaller value is greater than the locally selected flow rate, the smaller value is used as the air flow set point.

The ability to increase exhaust of the hoods 22 in response to an HVAC need may allow for a greater reduction in cost of operation. Rather than setting the hoods to exhaust at least an amount that could ever been needed to assist HVAC given a range of possible demand and range of general exhaust, the hoods may exhaust less during operation. The ability to request more exhaust from the hoods may then be used to deal with increased cooling, heating, or air change-out load.

In one embodiment, the room controller 24 is configured to set the HVAC exhaust damper 30 and the hood controller 26 is configured to set the hood exhaust damper 28 such that, during a first state, a total exhaust plus a transfer flow is less than a maximum cooling load of the HVAC system. Where the maximum load is not needed, the total exhaust may be set to less to conserve energy. Less conditioned air is supplied. This state of operation provides for energy savings.

During a second state, the demand or load on the HVAC system is greater. The room controller 24 is configured to adjust the HVAC exhaust damper 30 up to a maximum in response an increase in cooling demand. The hood controller 26 is configured to increase air flow by the hood exhaust damper 28 after the HVAC exhaust damper 30 reaches the maximum. This adjustment by the hood controller 26 is in response to a further increase in the cooling demand from where the general room exhaust damper 30 exhausts at a maximum level. Alternatively, the hood exhaust damper 28 is adjusted prior to or at a same time as the HVAC exhaust damper 30.

Figure 5:
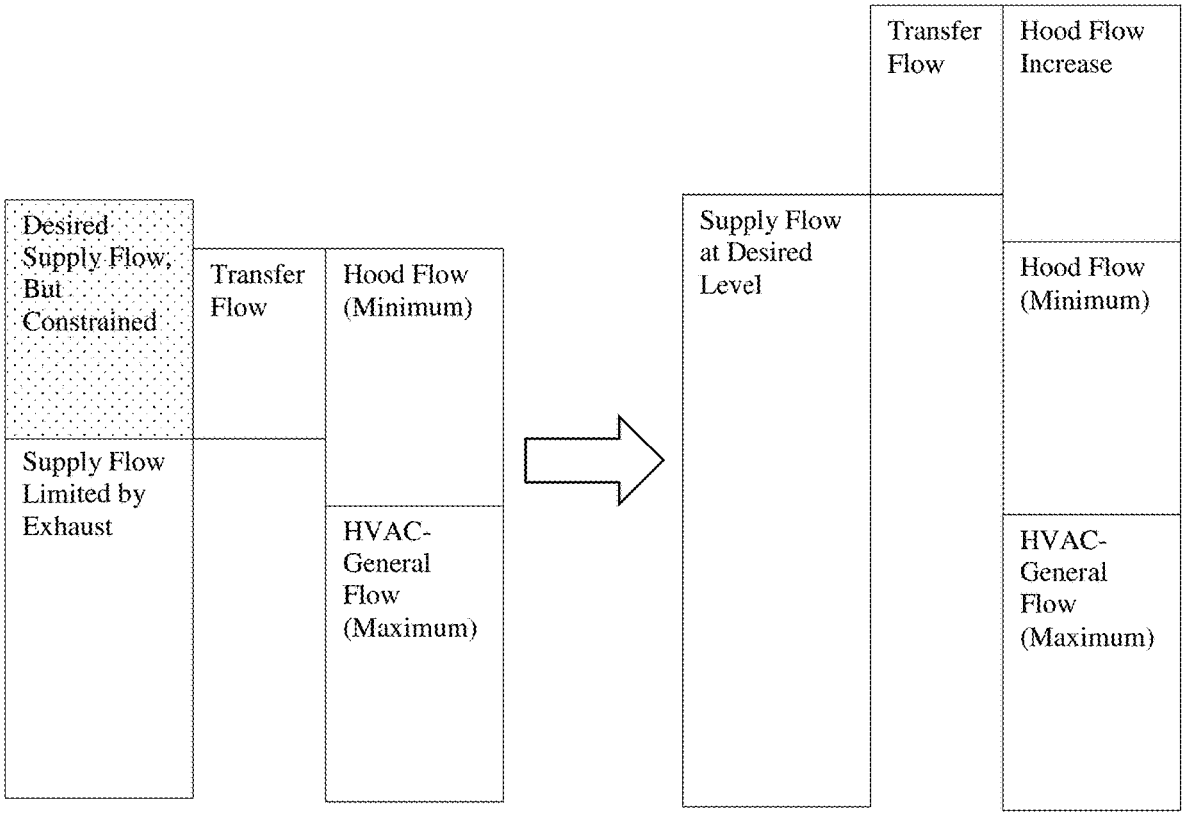
FIG. 5 illustrates use of fume hood exhaust to account for increasing HVAC demand.

FIG. 5 shows an example. On the left side, the general exhaust ventilation is at a maximum. The local exhaust ventilation is at a minimum or current set point. This total room exhaust, less the desired transfer flow, limits the supply flow that may be applied. The demand for cooling, heating, or conditioned air is greater than that total. After accounting for the transfer flow to maintain negative pressure in the laboratory, less than all the desired conditioned air is provided. On the right side, the exhaust from the hoods 22 is increased. Thus, the full or more of the demanded conditioned air or flow rate may be provided.

The ability for the hood exhaust to respond to requests from the HVAC application increases energy conservation opportunities. Air flow reductions at the local exhaust ventilation (e.g., hood) may proceed, unconstrained by variable flow demands, for cooling and general ventilation. When the cooling or other ventilation demands are high, the local exhaust ventilation flow increases to accommodate the increased or high demand. When the demand is low, the local exhaust ventilation flow decreases to conserve energy.

In one example illustrating the energy conservation opportunities, the laboratory has a supply terminal (e.g., air supply damper 32), general exhaust (e.g., general room exhaust damper 30) and one hood 22. The maximum cooling load is 1000 cfm. The hood 22 exhausts a constant 600 cfm. For negative pressure, the transfer flow is set at 200 cfm. The general exhaust (e.g., general room exhaust damper 30) operates over a range of 100 to 600 cfm. When cooling load is low, the supply flow may be at 500 cfm, driven by the hood exhaust plus general exhaust minus transfer flow. Where the hood exhaust is 600 cfm to account for the maximum air supply possible (e.g., 1000 cfm), the air supply may not be operated lower than 500 cfm, increasing costs. The laboratory wants to save energy by reducing hood flow and letting supply flow come down with the hood flow reduction. The hood 22 provides or is converted to provide variable volume, allowing the hood air flow to be as low as 200 cfm rather than setting the lowest level based on the highest possible demand. When the hood 22 is closed or operating at the minimum 200 cfm and the cooling load is low, the room 20 will draw less flow (e.g., 200 cfm from the hood, 100 cfm from the general exhaust, minus 200 cfm from the transfer flow=100 cfm) and use less energy. But when the cooling load is high, and the hood 22 is closed, the total exhaust can only go up to 600 cfm (general exhaust maximum plus hood minimum, minus transfer). This would limit cooling and overheat the room 20. By enabling the room controller 24 to increase hood flow when needed, then the maximum demand may be met (e.g., 1000 cfm air supply plus 200 cfm transfer flow provided by 600 cfm general exhaust and 600 cfm from the hood). This range of operation due to the hood responding to HVAC demand enables energy conservation.

For the hood 22, any displays and alarms continue to operate normally when the increased exhaust is in effect. The displayed flow or face velocity may be higher than normal. High flow alarms and warnings also continue. If a user applies the high flow warning or alarm and applies the increased exhaust feature, the alarm limits are configured to account for flow from both sources.

Figure 6:
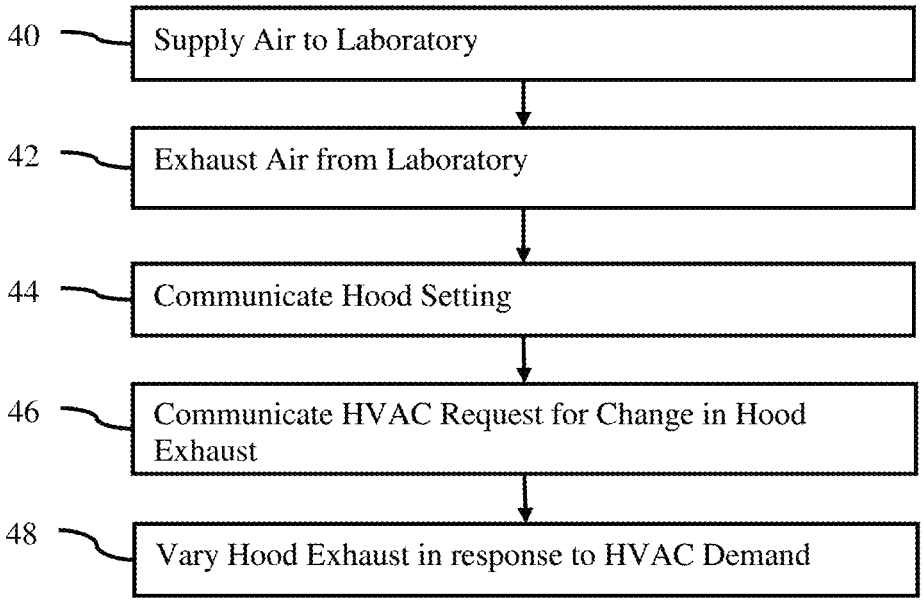
FIG. 6 is a flow chart diagram of one embodiment of a method for laboratory ventilation integration.

FIG. 6 is a flow chart diagram of one embodiment of a method for laboratory ventilation integration. The acts of FIG. 6 deal with integration of hood exhaust as responsive to HVAC demand. In addition to the HVAC system including hood flow exhaust in calculating supply, the HVAC system may request a change in hood flow exhaust to change supply. The hood flow is responsive to HVAC demand or load, allowing for greater cost savings during low demand by being responsive to requests for increased flow during high demand.

Additional, different, or fewer acts may be provided. For example, act 42 is divided into two separate acts, one for local exhaust and another for general exhaust. As another example, act 44 is not provided, such as where a room controller measures the hood air flow without communications from the hood controller. In yet another example, acts for limiting, configuring, or controlling operation of the hood for local reasons (e.g., for safety or to provide proper hood operation for a workstation) are provided.

The method is implemented by the system of FIG. 1, an HVAC system in a laboratory, controllers, dampers, exhaust ducts, or another system and/or component. For example, an air supply fan, duct, and/or damper under control of a room controller performs act 40. An exhaust fan, duct, and/or damper under control of the room controller performs act 42 for general exhaust, and a sash, damper, duct, and/or exhaust fan of a hood performs act 42 for hood or local exhaust. A hood controller performs act 44, and the room controller performs act 46. The damper and/or exhaust fan under control of the hood controller performs act 48. Other devices may perform any of the acts.

The acts are performed in the order shown (top to bottom) or other orders. For example, acts 40 and 42 are performed simultaneously. Acts 44-48 are performed while acts 40 and 42 are ongoing. Acts 44 and 46 may be performed simultaneously or in opposite order.

In act 40, conditioned air is supplied to a laboratory. The air is conditioned to be cool or warm in order the cool or heat the laboratory based on measurements from one or more temperature sensors. The air may be conditioned by filtering and/or being from a source outside the laboratory, such as for an air replacement.

A damper controls the amount of air flow into the laboratory. The damper is set based on instructions from a room controller, such as a panel.

The amount of air flow is set based on the amount of desired conditioning. A given flow is needed to keep the room at the desired temperature and/or to replace air in the laboratory at the desired rate. In some situations, the demand for conditioned air may be high, such as during very hot or very cold days, during high use of flame or cold in the laboratory, or during an emergency flush of the air (e.g., such as due to smoke detection). In other situations, the demand for conditioned air may be low.

The air supply is balanced with exhaust. As the laboratory is to maintain a negative pressure, the air supply is set to be less than the exhaust, creating transfer flow into the laboratory. During desired operation, the demand dictates the air supply and the air supply dictates the amount of exhaust. Where the exhaust is limited, the air supply is then also limited. Other considerations may be included in the relationship between air supply, demand, and exhaust.

In act 42, the conditioned air is exhausted from the laboratory. One or more general room exhausts remove some of the air. The general room exhaust is through one or more vents on the floor, wall, and/or ceiling. These vents are not positioned specifically to remove air from a workstation or local sub-volume specifically associated with technician work in the laboratory.

One or more fume hood exhausts remove some of the air. The fume hood exhaust includes a funnel or intake positioned relative to a workstation or local sub-volume specifically associated with technician work in the laboratory. For safety or as part of a laboratory process, localized air removal is desired. The fume hood exhausts the air locally within the laboratory for this purpose.

The total exhaust creates a negative pressure. A greater amount or flow of air is exhausted than is supplied by the air supply. The difference creates a negative pressure, which draws in transfer air through doors or other leaks. The transfer flow helps prevent gas, material, germs, or other airborne substances from leaving the laboratory other than through the controlled exhaust.

Dampers or fans control the amount of exhaust for the general room exhaust and the hood exhaust. A room controller controls the amount for the general room exhaust. A hood controller controls the amount for the hood exhaust. Other controllers or one controller for both may be used. For hood exhaust, the amount or set point of the exhaust and limits on minimum and/or maximum exhaust may be based on the local operation of the hood, not HVAC considerations. Each hood independently or separately operates to provide the desired air flow based on the workstation or reason for the hood. Within the minimum and/or maximum for hood operation, the hood may respond to requests to increase or decrease flow for HVAC considerations.

In act 44, a set point of the hood exhaust is communicated to the HVAC system or application. The hood or hood controller sends a message indicating the set point. The set point is the position of the damper, an actuator setting, a measured air velocity, a calculated volume flow, or other information that indicates or may be used to derive air flow through the hood exhaust.

The hood or hood controller may also communicate a maximum and/or minimum available by the hood exhaust. A range of operation is communicated. The range is based on capability without control limitations, such as reflecting a range of flow provided from the damper being fully opened to fully closed. The position of a sash may or may not be considered when determining the range. Any control limits, such as keeping velocity below a given level to avoid interfering with flame or activity at the workstation, may or may not be considered when determining the range.

The maximum and/or minimum are communicated in a same message or different message than the set point. The message or messages may be sent periodically or upon demand. Alternatively, the message or messages are sent when the value (e.g., set point, maximum, or minimum) changes.

The communication is over a link. The hood controller may directly connect to the room controller, such as through a wire, cable, or secured wireless. The hood controller may indirectly connect to the room controller, such as using addressed packets in a network.

In act 46, the room controller communicates a request for variation in the hood exhaust to the hood controllers. A same request is sent to all the hoods, or separate requests are sent to separate hoods. The hood controller or controllers receive the request. The request is for an amount of change, a desired set point for air flow, a percentage of the maximum or range, or other information indicating alteration of the hood air flow. Any format or message protocol may be used.

The request is sent in response to a change in the demand for conditioned air. Where current settings are not sufficient, the air supply is to be increased, such as in response to an increase in heating or cooling demand. The increase in air supply is offset by a same increase in exhaust. Some or all of the increase in exhaust is assigned to one or more hoods and corresponding requests are sent. In one embodiment, any increase in exhaust is handled by the general exhaust of the HVAC system until the general exhaust is maximized. The hood exhausts are maintained at a current set point. Once the general exhaust cannot increase further, then increases in exhaust is handled by the hood or hoods. The request is then generated. Other divisions of contribution and timing of change between the general and local exhaust may be used.

In act 48, the hood controller for each hood determines a response to the request. The hood controller receives the request and responds. In other embodiments, the room controller handles the control process for the hood, so the request is a command to vary operation of the hood.

Different hoods may respond differently. Incorporating or considering operation and/or limits for local use of the hood, the hood controller determines a response to the request. The sash position, velocity, or both may be considered when determining the response. The range of variation may be limited depending on the sash position and/or velocity of air flow. Thus, the variation in hood exhaust may be less than requested. The response may be to vary as requested (e.g., request does not exceed a limit), vary but less than requested, or not vary. In response to the request based on a change in demand for conditioned air, the exhaust of the hood may be varied.

The response may include an acknowledgement message or other message indicating a new set point or other change in air flow for the hood exhaust. Alternatively, the response is by change or not of the air flow. The room controller knows of the response based on the usual communication of the set point in act 44.

With the exhaust being varied, either through the general exhaust, hood exhaust, or both, the supply flow may also be varied. For example, the supply air flow is increased. Where the variation from the hoods is less than desired, the supply air flow may be increased but less than the full amount. Where variation from the hoods provides the desired level, the supply air flow is increased to the desired level. Where the variation from the hoods provides more than the desired level, a greater negative pressure may be accepted, the general exhaust may be reduced to provide the desired total exhaust, and/or one or more hoods may be requested to reduce the exhaust. The air supply is then set according to the provided total exhaust.

In an alternative embodiment, a positively pressurized room is used, such as a clean room. The above fume hood control is used to provide the desired positive pressure instead of negative pressure.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

We claim:

1. An integration system for laboratory ventilation, the system comprising:

a heating ventilation and air conditioning (HVAC) system comprising a room controller and an HVAC exhaust damper responsive to the room controller;

a hood comprising a hood controller and a hood exhaust damper responsive to the hood controller; and a communication link between the room controller and the hood controller;

wherein the room controller is configured to send a request for a change in an exhaust setpoint associated with a first air flow from the hood based on operation of the HVAC system and set the HVAC exhaust damper, wherein the hood controller is configured to adjust the exhaust setpoint associated with a second air flow from the hood in response to the request and set the hood exhaust damper such that, during a first state, a total exhaust plus a transfer flow is less than a maximum cooling load of the HVAC system, and wherein, during a second state, the room controller is configured to adjust the HVAC exhaust damper up to a first maximum in response to an increase in cooling demand and the hood controller is configured to increase air flow by the hood exhaust damper after the HVAC exhaust damper reaches the first maximum in response to a further increase in the cooling demand.

2. The integration system of claim 1 wherein the HVAC exhaust damper and the hood exhaust damper connect with a same duct.

3. The integration system of claim 1 wherein the hood comprises one of a plurality of hoods, each of the hoods having separate hood controllers and hood exhaust dampers, and wherein the room controller is configured to send the request for the first air flow distributed between the hoods.

4. The integration system of claim 1 wherein the hood comprises a fume hood with ventilation localized to a laboratory work station in a laboratory room conditioned by the HVAC system.

5. The integration system of claim 1 wherein the HVAC system comprises a laboratory HVAC system configured to provide negative pressure within a laboratory while conditioning the air of the laboratory.

6. The integration system of claim 1 wherein the room controller is configured to determine an air supply flow as a function of available exhaust from the hood, the available exhaust being greater than a current set point of exhaust of the hood.

7. The integration system of claim 1 wherein the room controller is configured to make the request when the HVAC exhaust damper is at a maximum flow.

8. The integration system of claim 1 wherein the hood controller is configured to report a set point for the second air flow and a maximum possible value for the second air flow to the room controller, and wherein the room controller is configured to make the request based on the set point being less than the maximum possible value.

9. The integration system of claim 1 wherein the room controller is configured to make the request as a percentage of a maximum flow rate.

10. The integration system of claim 3 wherein the room controller is configured to send the request to each of the hoods, and wherein each of the hood controllers are configured to respond independently of the other hood controllers.

11. The integration system of claim 1 wherein the hood controller is configured to adjust the second air flow to less than the first air flow in response to the request.

12. The integration system of claim 11 wherein the hood controller is configured to adjust the second air flow as a function of the request and a setting of a sash area or air velocity of the hood.

13. A system for laboratory ventilation integration, the system comprising:

a fume hood in a laboratory; and a controller of the fume hood, the controller having an interface for communicating with a heating, ventilation, and air conditioning (HVAC) application for the laboratory;

wherein the controller changes a set point to increase air flow by the fume hood in response to a message received at the interface from the HVAC application and set a hood exhaust damper such that, during a first state, a total exhaust plus a transfer flow being less than a maximum cooling load of the HVAC system, and wherein, during a second state where an HVAC exhaust damper is adjusted up to a first maximum by a room controller in response to an increase in cooling demand, the controller increases air flow by the hood exhaust damper after the HVAC exhaust damper reaches the first maximum in response to a further increase in the cooling demand.

14. The system of claim 13 wherein the controller is configured to change the set point by less than requested by the message.

* * * * *